US008401440B2

(12) United States Patent
Oba et al.

(10) Patent No.: US 8,401,440 B2
(45) Date of Patent: Mar. 19, 2013

(54) DEVELOPING DEVICE AND IMAGE FORMING APPARATUS

(75) Inventors: Shota Oba, Kanagawa (JP); Shigeru Inaba, Kanagawa (JP); Takashi Ochi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 296 days.

(21) Appl. No.: 12/853,845

(22) Filed: Aug. 10, 2010

(65) Prior Publication Data

US 2011/0229214 A1 Sep. 22, 2011

(30) Foreign Application Priority Data

Mar. 18, 2010 (JP) ..... 2010-062988

(51) Int. Cl.
*G03G 15/09* (2006.01)

(52) U.S. Cl. ..... 399/269; 399/119

(58) Field of Classification Search ..... 399/119, 399/120, 252, 265–269, 279, 281, 282
See application file for complete search history.

(56) References Cited

U.S. PATENT DOCUMENTS 3,882,821 A * 5/1975 Katayama et al. ..... 399/269
4,980,728 A * 12/1990 Funayama et al. ..... 399/276
7,352,983 B2 * 4/2008 Kamiya et al. ..... 399/277

FOREIGN PATENT DOCUMENTS

JP A-10-31368 2/1998
JP A-2002-268386 9/2002

* cited by examiner

*Primary Examiner* — Hoan Tran
(74) *Attorney, Agent, or Firm* — Oliff & Berridge, PLC

(57) ABSTRACT

A developing device includes: a first developer holding body with a first cylinder member disposed facing the outer peripheral surface of a rotating latent image holding body, and a first magnet disposed at the inside of the first cylinder member; a second developer holding body with a second cylinder member disposed facing the outer peripheral surface of the latent image holding body, further downstream in the latent image holding body rotation direction than the first developer holding body, and a second magnet disposed at the inside of the second cylinder member; and an adjustment mechanism that adjusts the relative position of the first magnet to the second magnet in a circumferential direction.

10 Claims, 11 Drawing Sheets

COMPARATIVE EXAMPLE

PRESENT EXEMPLARY EMBODIMENT

DEVELOPING DEVICE AND IMAGE FORMING APPARATUS

CROSS-REFERENCE TO RELATED APPLICATION

This application is based on and claims priority under 35 USC 119 from Japanese Patent Application No. 2010-062988 filed on Mar. 18, 2010.

BACKGROUND

Technical Field

The present invention relates to a developing device and an image forming apparatus.

SUMMARY

A developing device according to a first aspect of the present invention includes: a first developer holding body comprising a first cylinder member that is disposed facing the outer peripheral surface of a rotating latent image holding body and rotates such that a movement direction of the first cylinder member at a position facing the latent image holding body is the opposite direction to that of the latent image holding body, and a first magnet that is disposed at the inside of the first cylinder member and generates a magnetic field distributed along a circumferential direction at the outside of the first cylinder member, the first developer holding body holding a developer, for developing a latent image on the latent image holding body; a second developer holding body comprising a second cylinder member that is disposed facing the outer peripheral surface of the latent image holding body, further to the downstream side in the rotation direction of the latent image holding body than the first developer holding body, and rotates such that the movement direction of the second cylinder member at a position facing the latent image holding body is the same direction as that of the latent image holding body, and a second magnet that is disposed at the inside of the second cylinder member and generates a magnetic field distributed along a circumferential direction at the outside of the second cylinder member, the second developer holding body holding the developer, for developing the latent image on the latent image holding body; and an adjustment mechanism that adjusts the relative position of the first magnet to the second magnet in a circumferential direction.

BRIEF DESCRIPTION OF THE DRAWINGS

Exemplary embodiments of the present invention will be described in detail based on the following figures, wherein.

DETAILED DESCRIPTION

Explanation follows of an example of a developing device and an image forming apparatus according to an exemplary embodiment of the present invention.

Figure 1:
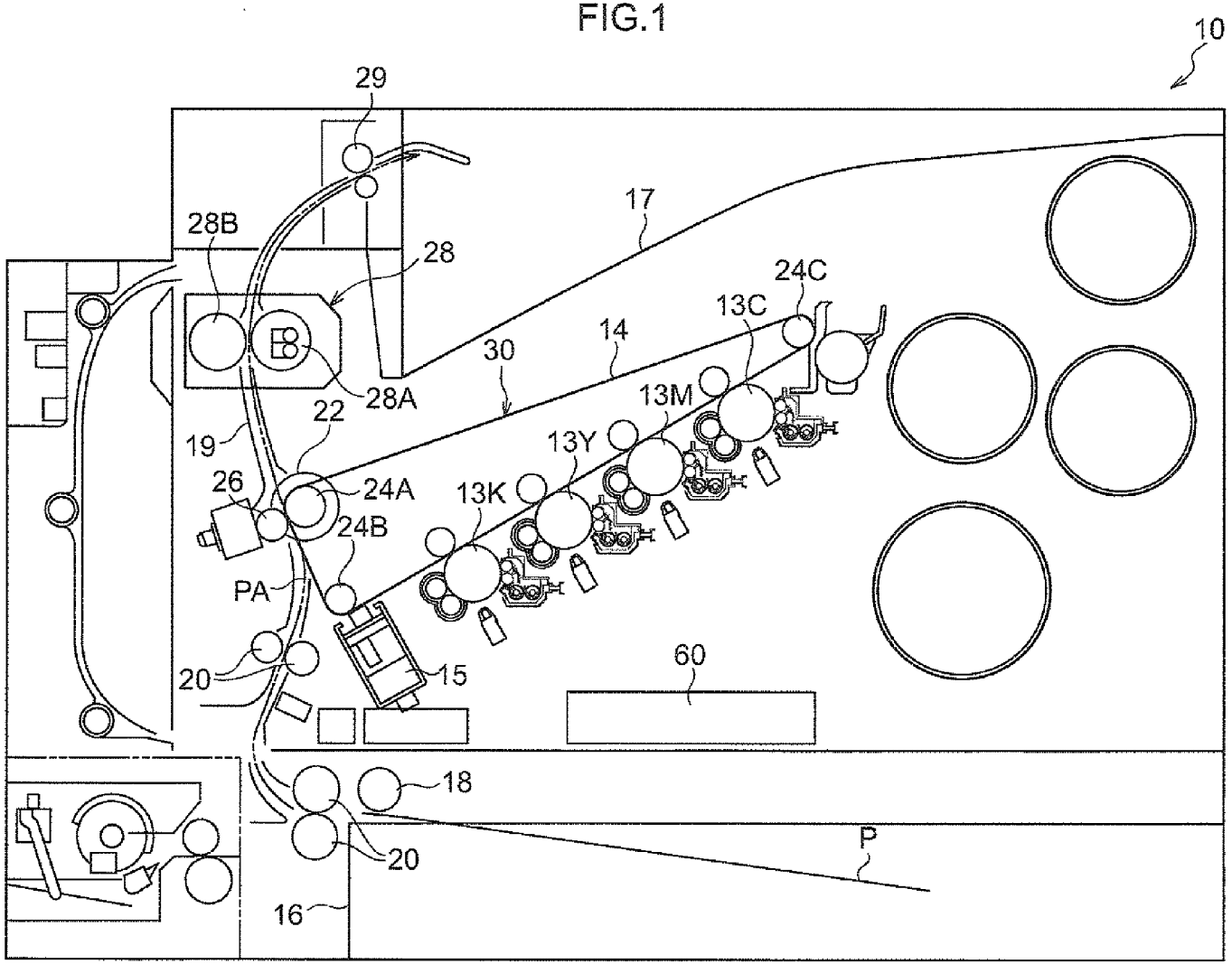
FIG. 1 is an overall view of an image forming apparatus according to an exemplary embodiment of the present invention.

An image forming apparatus 10 according to the present exemplary embodiment is shown in FIG. 1. The image forming apparatus 10, as an example thereof, includes: a paper supply section 16 provided at a bottom portion of the image forming apparatus 10; an image forming section 30, provided above the paper supply section 16 and forming images of four colors of toner (developer), these being yellow (Y), magenta (M), cyan (C), and black (K); a paper discharge section 17 provided above the image forming section 30; a conveying path 19 for conveying recording paper P (transfer receiving medium) from the paper supply section 16 through the image forming section 30; a fixing section 28 provided on the conveying path 19 for fixing toner images; and a controller 60 that controls operation of each section of the image forming apparatus 10. Note that in the explanation that follows, the suffix letters Y, M, C, K are applied when discriminating between each of the respective colors yellow, magenta, cyan and black, and the suffix letters Y, M, C, K are omitted when there is no need to discriminate between each of the colors.

The paper supply section 16 houses recording paper P therein, and a feed roll 18 is provided in the paper supply section 16 at the conveying direction leading end of the recording paper P, for feeding out the recording paper P from the paper supply section 16 one sheet at a time. Two pairs of conveying rolls 20 are provided to the conveying path 19 (conveying path PA) of the recording paper P, further to the downstream side than the feed roll 18, such that the recording paper P is conveyed to a secondary transfer portion 22, described below, provided above the conveying rolls 20.

Figure 2:
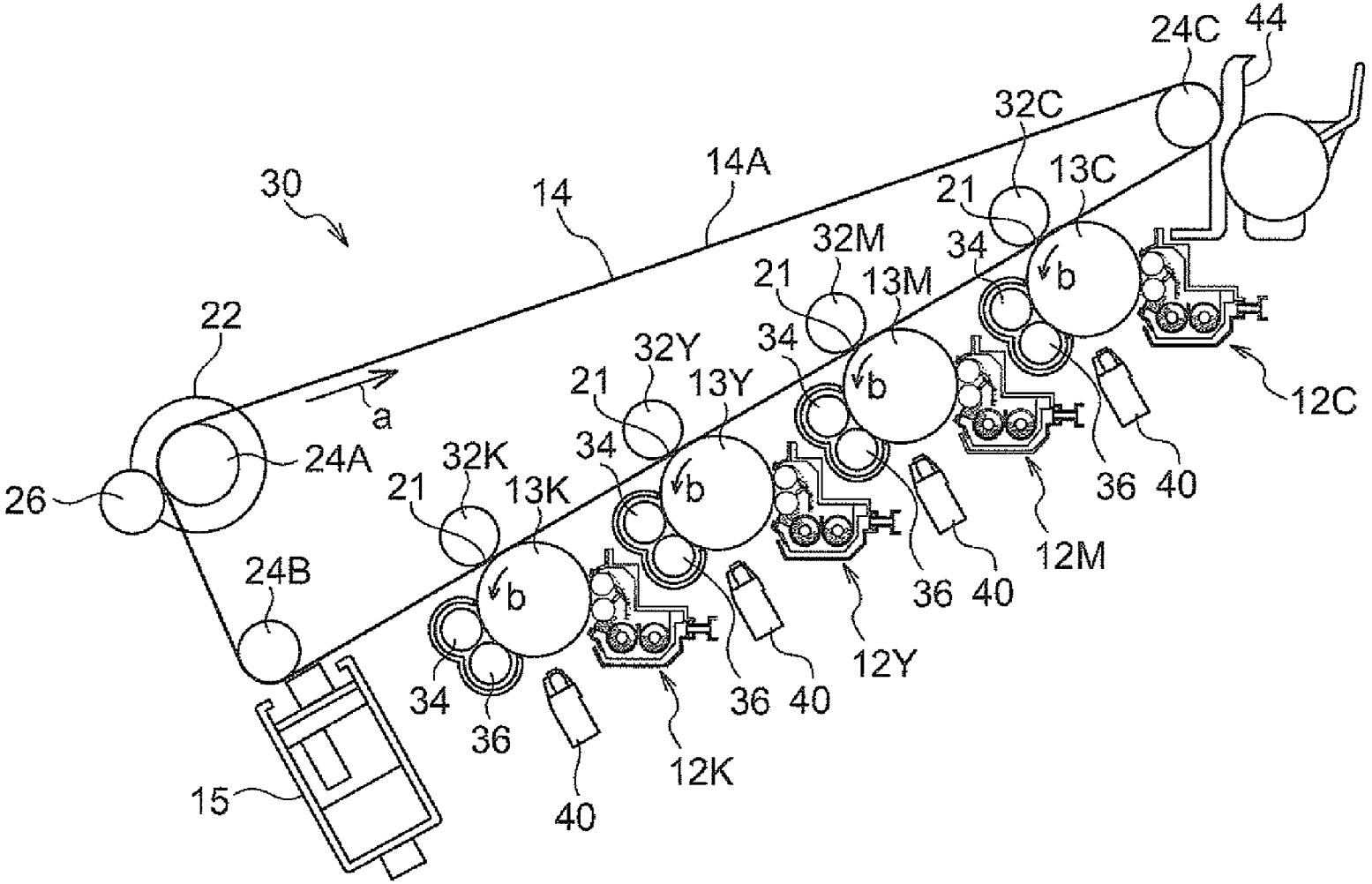
FIG. 2 is a schematic diagram showing an image forming section provided to an image forming apparatus according to an exemplary embodiment of the present invention.

As shown in FIG. 2, the image forming section 30 includes photoreceptors 13C, 13M, 13Y, 13K, serving as examples of a latent image holding body that holds latent image, corresponding to each of the colors yellow, magenta, cyan and black, with the photoreceptors 13C, 13M, 13Y, 13K provided in contact with an intermediate transfer belt 14, serving as an example of a transfer unit. The photoreceptors 13C, 13M, 13Y, 13K are configured so as to rotate in one direction (the direction of arrow b, this being the anticlockwise direction in the drawings).

Around the periphery of each of the photoreceptors 13 in the image forming section 30 are provided, in sequence in the rotation direction b of the photoreceptor 13 (arrow b direction): a charging roll 36, serving as an example of a charging unit, disposed facing the surface (outer peripheral surface) of the photoreceptor 13 and charging the surface of the photoreceptor 13 with an electrical potential difference; an exposure section 40, serving as an example of an exposure unit, irradiating exposure light onto the charged surface of the photoreceptor 13 and forming an electrostatic latent image on the surface of the photoreceptor 13 according to image data; a developing device 12 that develops the electrostatic latent image on the photoreceptor 13 using a developer and forms a developer image (toner image); the intermediate transfer belt 14, the developer images being transferred onto the outer peripheral surface thereof; and a brush roll 34 that cleans the outer peripheral surface of the photoreceptor 13 after the developer image has been transferred therefrom. Primary transfer rolls 32, serving as examples of a transfer unit, are provided on the opposite side of the intermediate transfer belt 14 to that of the photoreceptors 13, with the intermediate transfer belt 14 interposed therebetween, for transferring the developer images from the photoreceptors 13 onto the intermediate transfer belt 14, with primary transfer sections 21 configured by the photoreceptors 13, the intermediate transfer belt 14, and the primary transfer rolls 32.

The intermediate transfer belt 14 is formed in an endless shape, and is entrained around, and supported by, a belt conveying roll 24A, a belt conveying roll 24B disposed below the belt conveying roll 24A (in the figure below and to the right), and a belt conveying roll 24C disposed diagonally above the belt conveying roll 24B (in the figure diagonally above and to the right) at the opposite side to the conveying path 19 side. The intermediate transfer belt 14 is capable of circulatory movement in the arrow a direction by rotating the belt conveying roll 24C using a motor (not shown in the figures).

A toner density detection sensor 15 is provided in contact with the surface (outer peripheral surface) of the intermediate transfer belt 14 at the opposite side of the intermediate transfer belt 14 to that of the belt conveying roll 24B. The toner density detection sensor 15 has functionality for detecting the density of toner that has been transferred onto the surface (transfer surface) of the intermediate transfer belt 14. A cleaning section 44 is provided in contact with the outer peripheral surface of the intermediate transfer belt 14 on the opposite side of the intermediate transfer belt 14 to that of the belt conveying roll 24C. The cleaning section 44 has functionality for cleaning the outer peripheral surface of the intermediate transfer belt 14 after secondary transfer.

A secondary transfer roll 26, serving as an example of a transfer unit, is further provided, at the opposite side of the intermediate transfer belt 14 to that of the belt conveying roll 24A. The secondary transfer roll 26 is applied with a set bias voltage and transfers toner images held on the outer peripheral surface of the intermediate transfer belt 14 onto the recording paper P. A secondary transfer section 22 is configured by the intermediate transfer belt 14 and the secondary transfer roll 26.

The fixing section 28 is provided above the secondary transfer section 22, as shown in FIG. 1. The fixing section 28 includes a fixing roll 28A with an internal heat source, and a press roll 28B that presses the outer peripheral surface of the fixing roll 28A, such that a toner image on the recording paper P is fused, solidified and fixed when the recording paper P passes through a nip portion configured by the fixing roll 28A and the press roll 28B.

Explanation follows regarding an image forming method of the image forming apparatus 10.

As shown in FIG. 1 and FIG. 2, in the image forming apparatus 10, first, image data is output from, for example, a personal computer or the like, and image processing is executed by an image processing device (not shown in the figures). In the image processing device, image processing is performed on the input reflection rate data including, for example, shading correction, positional misalignment correction, brightness/color space conversion, gamma correction, frame removal and various types of image editing such as, for example, color editing, movement editing and the like. The image data that has been subjected to image processing is converted into color gradation data of four colors, Y, M, C, K, and is output by color to the respective exposure section 40.

In each of the exposure sections 40, a light beam (exposure light) is irradiated onto the surface of the respective photoreceptor 13C, 13M, 13Y, 13K according to the color gradation data. The surface of the respective photoreceptor 13C, 13M, 13Y, 13K has been charged in advance by the charging roll 36, and an electrostatic latent image is formed on the surface by the light beam. The electrostatic latent images formed on the photoreceptor 13C, 13M, 13Y, 13K surfaces are developed as toner images for each color, C, M, Y, K, by the respective developing device 12C, 12M, 12Y, 12K.

Then, the toner images formed on the photoreceptors 13C, 13M, 13Y, 13K are primary transferred onto the intermediate transfer belt 14 by the primary transfer rolls 32C, 32M, 32Y, 32K at the primary transfer sections 21. This primary transfer is performed to give toner images of each of the colors superimposed in succession on the outer peripheral surface of the intermediate transfer belt 14. The intermediate transfer belt 14, onto which the toner images have been transferred, is conveyed to the secondary transfer section 22.

As shown in FIG. 1, recording paper P of the set size is fed from the paper supply section 16 out to the secondary transfer section 22 with a timing to match conveying of the toner images to the secondary transfer section 22. Furthermore, positional alignment of the position of the recording paper P and the position of the toner image is performed by temporarily halting conveying of the recording paper P fed out from the paper supply section 16 just prior to arrival at the secondary transfer section 22, and by rotation of a positional alignment roll (not shown in the figures) to match the movement timing of the intermediate transfer belt 14 holding the toner image on its surface.

At the secondary transfer section 22, the recording paper P conveyed with matched timing is nipped and fed between the intermediate transfer belt 14 and the secondary transfer roll 26. When this is occurring, an electrical potential (secondary transfer bias) of opposite polarity to the toner charge polarity (which is, as an example, a minus polarity) is applied to the secondary transfer roll 26, and the unfixed toner images held on the intermediate transfer belt 14 are electrostatically transferred all at once (secondary transferred) onto the recording paper P.

Then, the recording paper P onto which the toner images have been secondary transferred is conveyed to the fixing section 28. At the fixing section 28, the unfixed toner images on the recording paper P are heated and pressed by the fixing roll 28A and the press roll 28B, and fixed to the recording paper P. The recording paper P, to which the toner images were fixed at the fixing section 28, is discharged into the paper discharge section 17, by the paper discharge rolls 29 disposed at the conveying direction downstream side of the fixing section 28. Toner remaining on the intermediate transfer belt 14 after completing transfer to the recording paper P is removed from the intermediate transfer belt 14 by the cleaning section 44. Image forming of the image forming apparatus 10 is performed in the above manner.

Next, explanation follows of configuration of the developing device 12.

Figure 3:
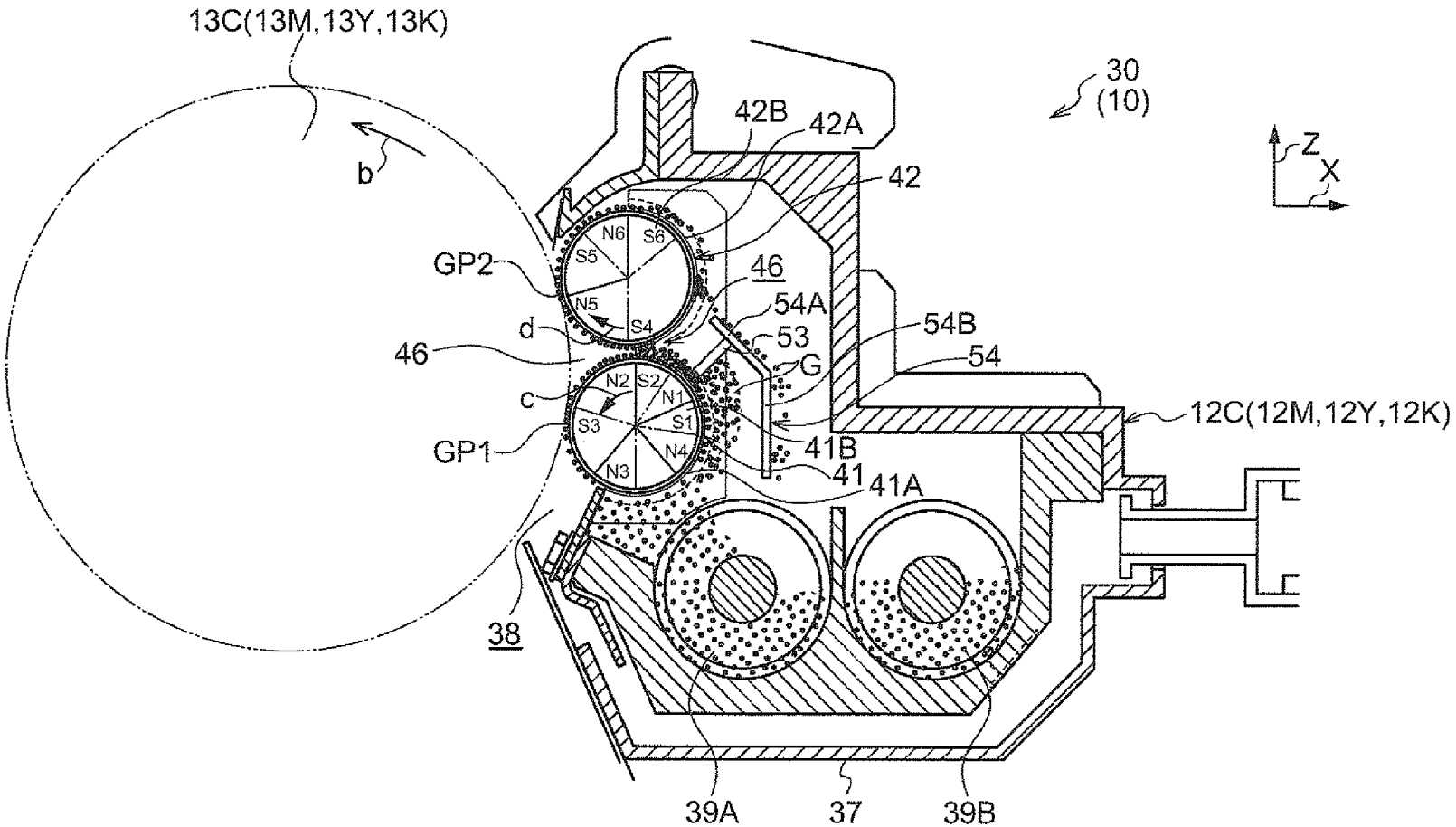
FIG. 3 is a schematic diagram showing a configuration of a developing device according to an exemplary embodiment of the present invention.

As shown in FIG. 3, the developing devices 12C, 12M, 12Y, 12K are each provided with a casing 37 having an opening 38 at a position facing the respective photoreceptor 13C, 13M, 13Y, 13K. A first developing roll 41, serving as an example of a first developer holding body, is housed in the casing 37 disposed facing the surface (outer peripheral surface) of the photoreceptor 13. The first developing roll 41 rotates in the same direction as the photoreceptor 13 such that the movement direction (arrow c direction) of the first developing roll 41 at a position GP1 facing the photoreceptor 13 is the opposite direction to the movement direction of the photoreceptor 13. Developer G is held on the surface (outer peripheral surface) of the first developing roll 41. A second developing roll 42, serving as an example of a second developer holding body, is housed in the casing 37, disposed above the first developing roll 41 (above in the arrow Z direction, which is the vertical direction) and facing the surface (outer peripheral surface) of the photoreceptor 13. The second developing roll 42 rotates in the opposite direction to the photoreceptor 13 such that the movement direction (arrow d direction) at a position GP2 facing the photoreceptor 13 is the same direction as the movement direction of the photoreceptor 13. Developer G received from the first developing roll 41 at a handing over portion 46, described below, is held on the surface (outer peripheral surface) of the second developing roll 42. Augers 39A, 39B are also housed in the casing 37, disposed side-by-side along the horizontal direction (arrow X direction) below the first developing roll 41, and the augers 39A, 39B convey the developer G to the first developing roll 41.

The augers 39A, 39B are disposed side-by-side below the first developing roll 41 (at the bottom right side in the figure) so as to perform circulatory conveying of the developer G. While the developer G is being stirred by rotation of the augers 39A, 39B, the developer G is conveyed along the rotational axial direction of the first developing roll 41 and the developer G is supplied to the first developing roll 41. The developer G employed in the developing device 12 is a magnetic developer with magnetism, and contains resin toner and magnetic carrier particles as the principal components thereof. The magnetic carrier particles, toner, and developer G are all examples of a conveyed agent.

The first developing roll 41 is disposed such that its rotation axis direction is along the rotation axis direction of the photoreceptor 13, facing the outer peripheral surface of the photoreceptor 13. The first developing roll 41 includes: a hollow first developing sleeve 41A, serving as an example of a first cylinder member, with a movement direction at the position GP1 facing the photoreceptor 13 of the opposite direction (this being the arrow c direction) to that of the photoreceptor 13; and a cylindrical shaped first inner body 41B, serving as an example of a first magnet, disposed at the inside of the first developing sleeve 41A and generating a magnetic field distributed in the circumferential direction at the outside of the first developing sleeve 41A. The first developing roll 41 thereby develops the latent image on the photoreceptor 13 with the developer G at the position GP1 facing the photoreceptor 13.

The second developing roll 42 is disposed such that its rotation axis direction is along the rotation axis direction of the photoreceptor 13, facing the outer peripheral surface of the photoreceptor 13 further to the downstream side than the first developing roll 41 in the rotation direction of the photoreceptor 13. The second developing roll 42 includes: a hollow second developing sleeve 42A, serving as an example of a second cylinder member, with a movement direction at the position GP2 facing the photoreceptor 13 being the same direction (this being the arrow d direction) as that of the photoreceptor 13; and a cylindrical shaped second inner body 42B, serving as an example of a second magnet, disposed at the inside of the second developing sleeve 42A and generating a magnetic field distributed in a circumferential direction at the outside of the second developing sleeve 42A. The second developing roll 42 thereby develops the latent image on the photoreceptor 13 with the developer G at the position GP2 facing the photoreceptor 13.

The first developing roll 41 and the second developing roll 42 are disposed so as to face each other along the arrow Z direction such that a gap is formed between the outer periphery of the first developing sleeve 41A and the outer periphery of the second developing sleeve 42A. At the handing over portion 46 formed between the first developing sleeve 41A and the second developing sleeve 42A (at the minimum separation portion), passing and receiving is performed of the developer G that has been held on the surface of the first developing sleeve 41A and conveyed thereto. The first developing roll 41 and the second developing roll 42 are disposed facing out of the opening 38 of the casing 37, so as to face the photoreceptor 13 with respective gaps formed between the surface of the photoreceptor 13 (at the facing positions GP1, GP2 described above) and each of the first developing roll 41 and the second developing roll 42. Note that the first developing sleeve 41A and the second developing sleeve 42A are rotationally driven in opposite directions to each other by gears (not shown in the figures) mounted to cap members 43 (see FIG. 4B) at one respective end, of the cap members 43 fitted into both ends of the first developing sleeve 41A and the second developing sleeve 42A, being meshed with a common gear.

A layer forming member 53, for leveling the height of a layer of the developer G held on the first developing roll 41, is provided further to the upstream side than the handing over portion 46 in the rotation direction of the first developing roll 41. The layer forming member 53 is a rectangular shaped cross-section plate member, running along a radial direction at the outer periphery of the first developing roll 41, and is disposed such that one edge face of the rectangular shaped cross-section faces the outer peripheral surface of the first developing roll 41, with the other edge face thereof fixed to a guide plate 54 provided in the casing 37.

The guide plate 54 is a shallow V-shape in cross-section, configured with an inclined portion 54A, disposed at an angle to the vertical direction along a radial direction at the outer periphery of the second developing roll 42 and fixed to the layer forming member 53, and a vertical section 54B, extending towards the auger 39A from a bottom end of the inclined portion 54A. By the guide plate 54 guiding the developer G downwards, developer G that has fallen off from the second developing roll 42 (the second developing sleeve 42A) falls at a position (above the auger 39A) separated from the first developing roll 41 (the first developing sleeve 41A), suppressing re-adhering to the first developing roll 41.

The circumferential direction position (rotation angle) of the first inner body 41B is adjustable by an angle adjustment plate 70 (see FIG. 4A), described in detail later, serving as an example of an adjustment mechanism, such that the first inner body 41B is fixed to the casing 37, in a manner described below, after the circumferential direction position has been determined. The second inner body 42B is fixed to the casing 37 so as not to rotate.

The first inner body 41B is configured with 7 bars of permanent magnets as principal components, these being 4 North (N) poles disposed around the rotation direction of the first developing sleeve 41A (the circumferential direction of the first inner body 41B), and 3 South (S) poles disposed between the four N poles. In FIG. 3, the center of each of the magnetic poles in the circumferential direction is shown, with a solid line for the N poles and a single dot broken line for the S poles.

More specifically, the 7 bars of permanent magnet are configured, in the rotation direction of the first developing sleeve 41A, with: a layer forming pole N1 that is disposed in the vicinity of the layer forming member 53, and that, together with the layer forming member 53, forms a layer of the developer G; a conveying pole S2 disposed in the vicinity of the layer forming member 53, further to the downstream than the layer forming pole N1, holding the developer G so as to render it conveyable; a handing over pole N2 disposed further to the downstream side than the conveying pole S2 and facing the handing over portion 46; a developing pole S3 disposed further to the downstream side than the handing over pole N2 and facing towards the position GP1 facing the outer peripheral surface of the photoreceptor 13; a pick-off pole N3 disposed further to the downstream side than the developing pole S3 and releasing restraint due to magnetic force on the developer G; a pick-up pole N4 disposed further to the downstream side than the pick-off pole N3, facing towards the auger 39A and attracting and adhering the developer G with magnetic force; and a conveying pole S1 disposed further to the downstream side than the pick-up pole N4 and further to the upstream side than the layer forming pole N1, holding the developer G so as to render it conveyable.

The second inner body 42B is configured with 5 bars of permanent magnet, these being 3 S poles disposed around the rotation direction of the second developing sleeve 42A (the circumferential direction of the second inner body 42B), and 2 N poles disposed between the 3 S poles.

More specifically, these 5 bars of permanent magnet are configured, in the rotation direction of the second developing sleeve 42A, with: a receiving pole S4 disposed facing the handing over portion 46 and receiving developer G; a developing pole N5 disposed further to the downstream side than the receiving pole S4 and facing towards the position GP2 facing the outer peripheral surface of the photoreceptor 13; conveying pole S5 disposed further to the downstream side than developing pole N5, and holding the developer G remaining on the surface of the second developing sleeve 42A after developing so as to render it conveyable; a conveying pole N6 disposed further to the downstream side than the conveying pole S5 and holding developer G on the surface of the second developing sleeve 42A so as to render it conveyable; and a pick-off pole S6 disposed further to the downstream side than conveying pole N6 and dropping off the developer G.

Figure 5:
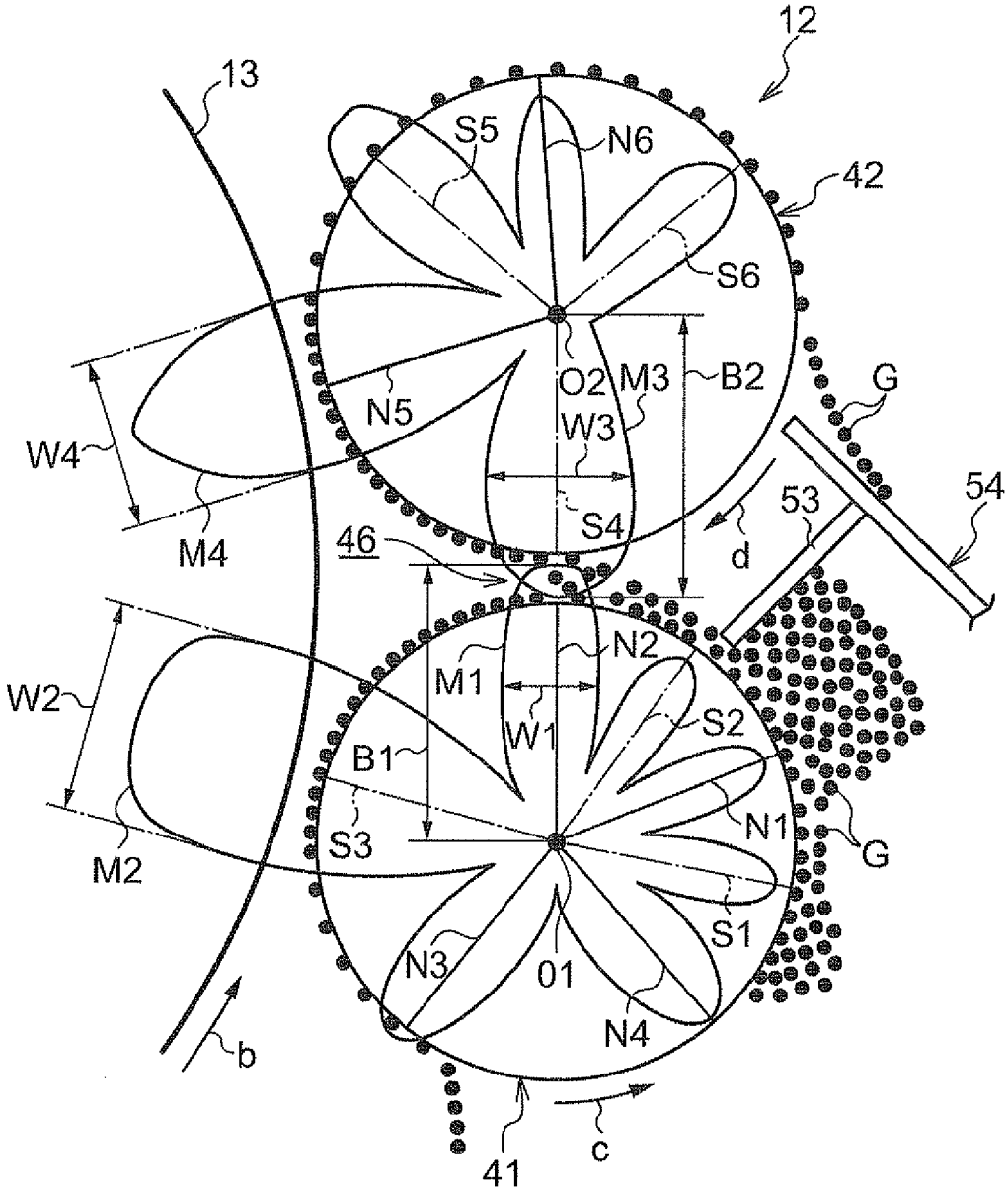
FIG. 5 is a schematic diagram of magnetic flux density distributions of first and second developing rolls according to an exemplary embodiment of the present invention.

FIG. 5 shows an schematic diagram of magnetic flux density distributions (magnitude of magnetic flux density) of the first developing roll 41 and the second developing roll 42. In FIG. 5, the rotational center of the first developing roll 41 is shown as O1, the rotational center of the second developing roll 42 is shown as O2, the magnetic flux density distribution at the handing over pole N2 is shown as M1, the magnetic flux density distribution at the developing pole S3 is shown as M2, the magnetic flux density distribution at the receiving pole S4 is shown as M3, and the magnetic flux density distribution at the developing pole N5 is shown as M4. The section widths when the magnetic flux density distribution is sectioned at half way from the rotational center O1, or the rotational center O2, to the maximum value of the magnetic flux density at each of the magnetic poles of the first developing roll 41 and the second developing roll 42, are shown as half value widths W, with the half value width of the handing over pole N2 shown as W1, the half value width of the developing pole S3 shown as W2, the half value width of the receiving pole S4 shown as W3, and the half value width of the developing pole N5 shown as W4. Note that the half value widths W correspond to an example of a range where the magnetic flux density is a predetermined proportion of the maximum magnetic flux density of each of the magnetic poles.

In the developing device 12, each of the magnetic poles of the first inner body 41B and the second inner body 42B are magnetized, at the handing over portion 46 where the first developing roll 41 faces the second developing roll 42, such that the half value width W1 of the first inner body 41B is a less than the half value width W3 of the second inner body 42B (W1<W3), namely, such that the shape of the magnetic flux density distribution M1 of the handing over pole N2 is more pointed than the shape of the magnetic flux density distribution M3 of the receiving pole S4. In the developing device 12, each of the magnetic poles of the first inner body 41B and the second inner body 42B are magnetized such that the half value width W2 at the position of the first inner body 418 facing the photoreceptor 13 is greater than the half value width W4 of the position of the second inner body 42B facing the photoreceptor 13 (W2>W4), namely, such that the shape of the magnetic flux density distribution of the developing pole S3 is wider in width than the shape of the magnetic flux density distribution of the developing pole N5.

Figure 7A:
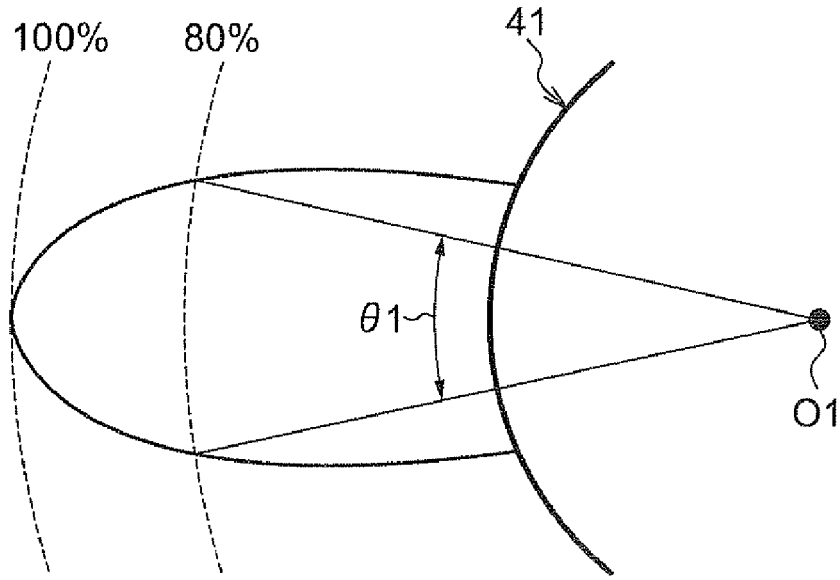
FIG. 7A is a schematic diagram showing a magnetic flux density distribution state at a developing pole of a second developing roll according to an exemplary embodiment of the present invention.
Figure 7B:
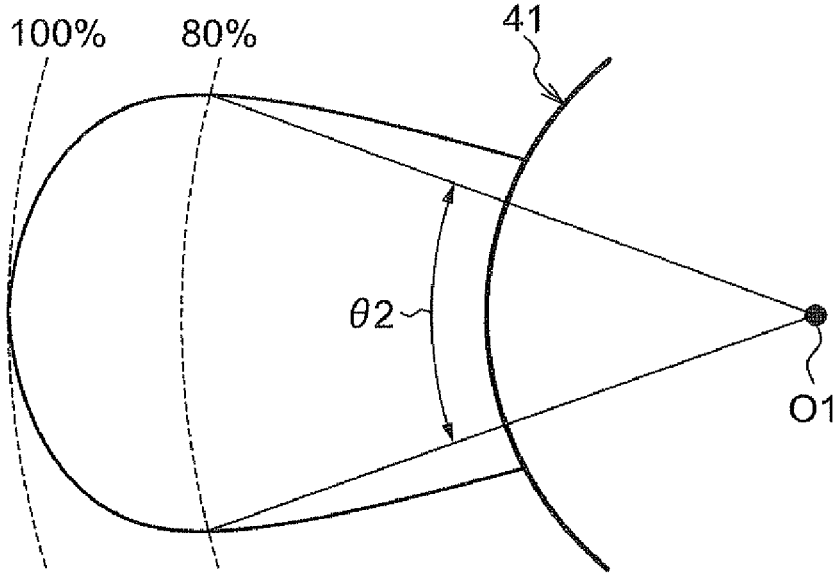
FIG. 7B is a schematic diagram showing a magnetic flux density distribution state at a developing pole of a first developing roll according to an exemplary embodiment of the present invention.
Figure 8A:
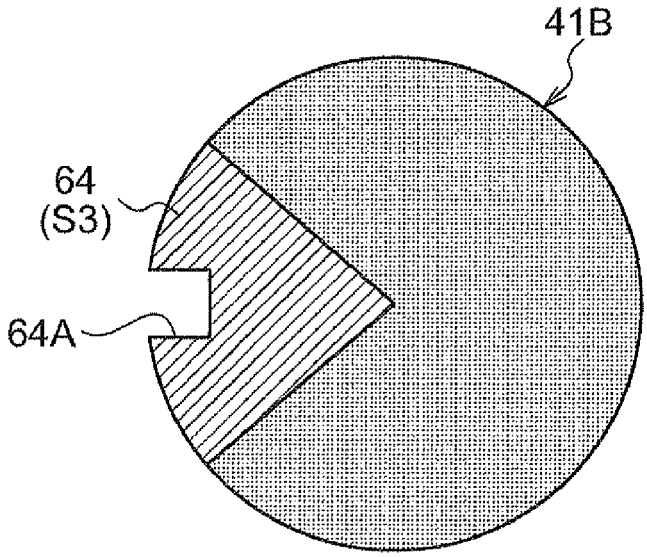
FIG. 8A is a cross-section of another exemplary embodiment of a first inner body of the present invention.
Figure 8B:
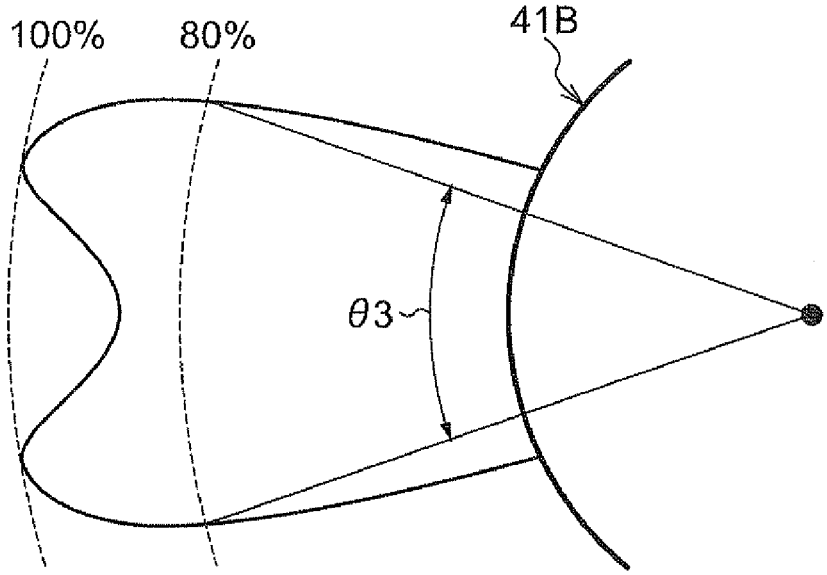
FIG. 8B is a schematic diagram showing a magnetic flux density distribution state at a developing pole in another exemplary embodiment of the first inner body of the present invention.

With regard to the magnetic flux density distribution shapes in the present exemplary embodiment, when, not in a relative comparison, simply the width of the magnetic flux density distribution shape is said to be wide this means that, with an open angle of θ1 (from 10° up to, but not including, 30°) at 80% of the maximum magnetic flux density (100%) of the magnetic flux density distribution taken as "normal", as shown in FIG. 7A, the open angle is θ2 (30° or greater) at 80% of the maximum magnetic flux density (100%), as shown in FIG. 7B. Note that as a method for widening the width of the magnetic flux density distribution shape (increasing the open angle), the angle of the magnetic poles (the magnetized range in the circumferential direction) may be widened. The pitch of the magnetic poles may be made finer by disposing more poles, e.g., N pole, S pole, N pole . . . etc. In addition, as shown in FIG. 8A, in the first inner body 41B configured by plural magnets, a cutout MA, where a circumferential direction portion is cutout, may be formed in a main magnetic pole 64 (developing pole S3). A heteropole may be embedded in the cutout 64A to give a bifurcated (open angle θ3) leading end of a magnetic pole, as shown in FIG. 8B. Note that the open angles θ1, θ2 correspond to another example of a range where the magnetic flux density at each of the magnetic poles is a predetermined proportion of the maximum magnetic flux density.

As shown in FIG. 5, in the developing device 12, the handing over pole N2 and the receiving pole S4 magnetized to each other such that, with the maximum value of the magnetic flux density from the rotational center O1 of the first developing roll 41 at the handing over pole N2 shown as B1, and the maximum value of the magnetic flux density from the rotational center O2 of the second developing roll 42 at the receiving pole S4 shown as B2, the maximum value B1≈maximum value B2. At the handing over portion 46 where the first developing roll 41 faces the second developing roll 42, the developer G, whose layer thickness has been controlled by the layer forming member 53, is split according to the size of the maximum value B1 of the magnetic flux density of the magnetic flux density distribution M1 and the maximum value B2 of the magnetic flux density distribution M3.

Figure 6A:
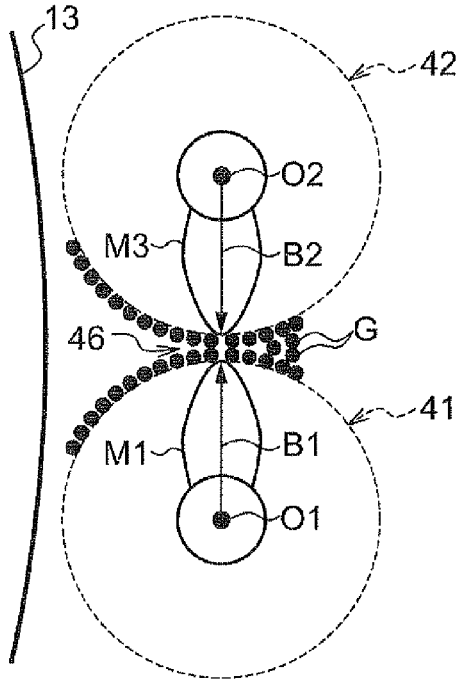
FIG. 6A and FIG. 6B are schematic diagrams showing a difference in developer holding amounts distributed to the first and second developing rolls when the magnitude of the magnetic flux density is changed at a position where the first developing roll faces the second developing roll according to an exemplary embodiment of the present invention.
Figure 6B:
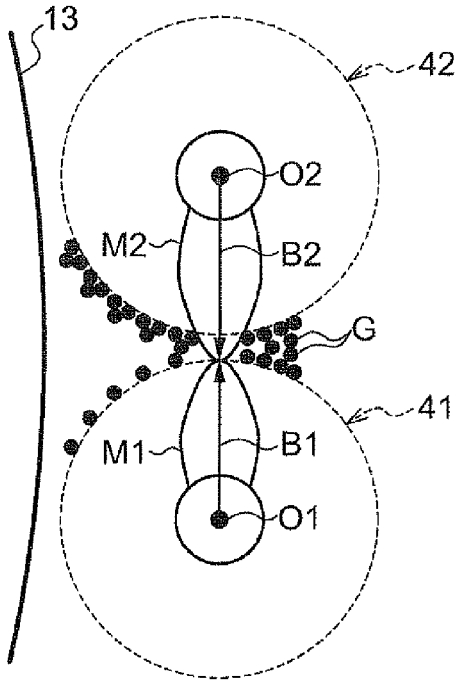

As shown in FIG. 6A, when the maximum value B1 maximum value B2 at the handing over portion 46, the split ratio is such that developer holding amount held on the first developing roll 41 and the developer holding amount held on the second developing roll 42 are substantially the same as each other. In contrast thereto, when, for example, as shown in FIG. 6B, the maximum value B1<maximum value B2 at the handing over portion 46, the proportion of developer holding amount held on the second developing roll 42 is greater in comparison to the developer holding amount held on the first developing roll 41.

Next, explanation follows regarding the angle adjustment plate 70.

Figure 4A:
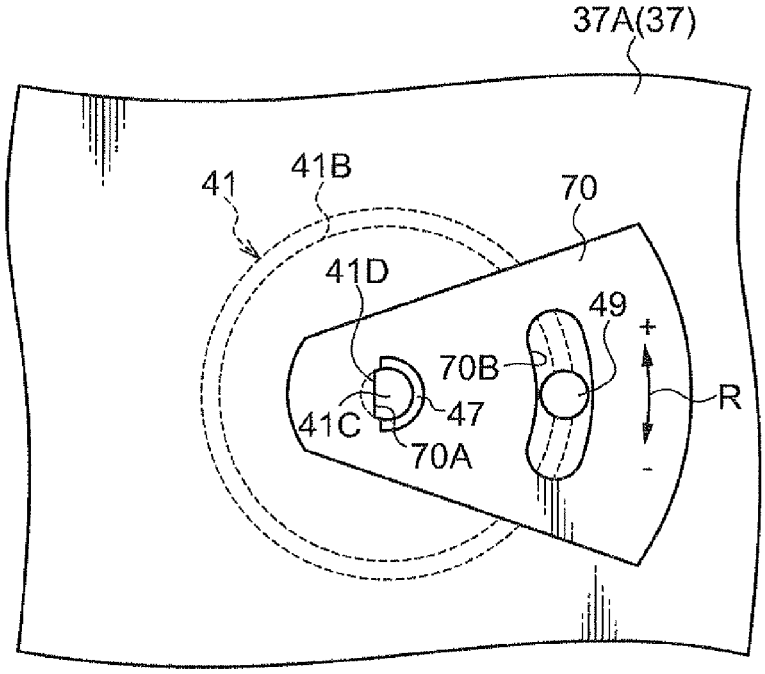
FIG. 4A is a schematic diagram showing an angle adjustment plate of a first inner body according to an exemplary embodiment of the present invention.
Figure 4B:
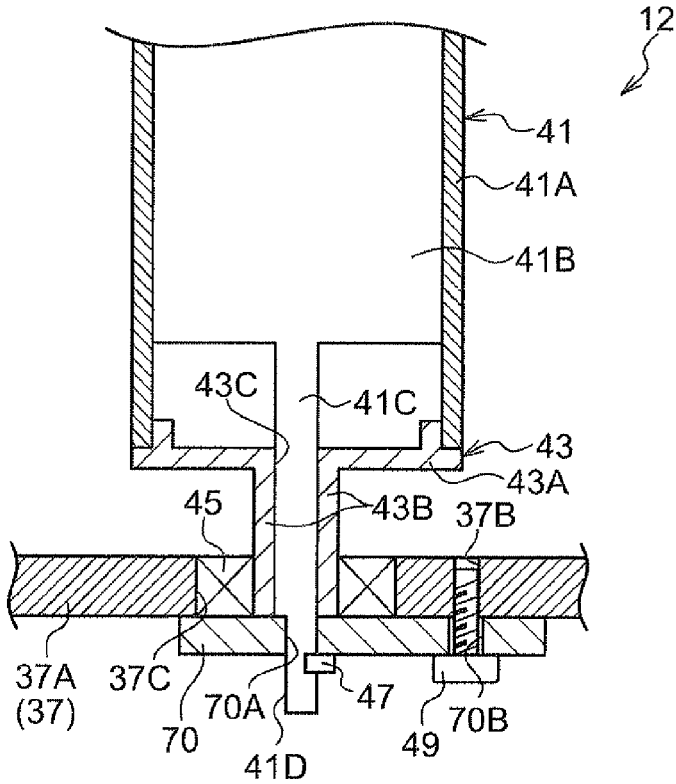
FIG. 4B is a cross-section of a first developing roll and an angle adjustment plate of a first inner body in a developing device according to an exemplary embodiment of the present invention.

As shown in FIG. 4B, a circular pillar shaped support shaft 41C is provided protruding towards the outside in an axial direction at an end face of the first inner body 41B on the first developing roll 41. An end portion of the support shaft 41C is cut away, forming a non-circular shaped shaft 41D, D-shaped in cross-section. A cap member 43 is fitted to the axial direction end portion of the cylindrical shaped first developing sleeve 41A, closing off the end face of the first developing sleeve 41A.

The cap member 43 has a circular plate portion 43A that closes off the end face of the first developing sleeve 41A, a shaft portion 43B protruding out towards the outside from the center of the circular plate portion 43A, and a through hole 43C piercing in succession through the circular plate portion 43A and the shaft portion 43B. The inside diameter of the through hole 43C is a size such that the support shaft 41C is insertable therein. The first developing sleeve 41A is supported so as to be rotatable with respect to the casing 37, by inserting the shaft portion 43B into a bearing 45 attached to a side wall 37A of the casing 37, in a state in which the support shaft 41C is inserted into the through hole 43C. Only the non-circular shaped shaft 41D protrudes out to the outside from the side wall 37A when the shaft portion 43B is in an inserted state into the bearing 45. The bearing 45 is fitted into a through hole 37C formed in the side wall 37A and fixed.

The angle adjustment plate 70, for adjusting the fixing angle (rotation angle) of the first inner body 418, is provided to the outside of the side wall 37A. As shown in FIG. 4A, the angle adjustment plate 70 is a vane shaped plate member, with a through hole 70A formed in a D shape at a position at the center of a circular arc of the vane shape, into which the non-circular shaped shaft 41D of the cap member 43 is inserted. An elongated hole 70B is also formed in the angle adjustment plate 70 along a circumferential direction (arrow R direction) at a position separated from the through hole 70A in the radial direction of the vane shape. The arrow R direction has a +R direction which is anticlockwise in the figure, and a −R direction which is clockwise therein. The first developing roll 41 is only provided with the angle adjustment plate 70 at one end thereof, and, while not shown in the figures, the shaft portion 43B of the cap member 43 and the support shaft 41C of the first inner body 41B are in a supported state by the bearing 45 at the other end thereof.

As shown in FIG. 4B, in a state in which the shaft portion 43B is inserted into the bearing 45 and the non-circular shaped shaft 41D is inserted into (fitted into) the through hole 70A of the angle adjustment plate 70, the angle of the first inner body 41B is adjustable (changeable) in the arrow R direction by moving the angle adjustment plate 70 in the arrow R direction. An E-ring 47, serving as a first inner body detachment preventer, is attached to the non-circular shaped shaft 41D. A fastening hole 37B, into which a screw 49 is fastened, is formed in the side wall 37A of the casing 37, and the angle adjustment plate 70 is fixed with respect to the casing 37 by fastening the screw 49 inserted through the elongated hole 70B in the fastening hole 37B. Accordingly, changing the angle of the first inner body 41B is performed by moving the angle adjustment plate 70 in the arrow R direction in a state in which fastening of the screw 49 has been loosened.

Next, explanation follows regarding the conveying state of the developer G in the developing device 12.

As shown in FIG. 3, in the developing device 12, the developer G is supplied to the first developing roll 41 by the augers 39A, 39B. The developer G supplied to the first developing roll 41 is attracted to (held on) the outer peripheral surface (surface) of the first developing sleeve 41A by the pick-up pole N4. When this occurs, the developer G is adhered to the surface of the first developing sleeve 41A in a magnetic brush state.

The developer G held on the surface of the first developing sleeve 41A is conveyed, accompanying rotation of the first developing sleeve 41A in rotation direction c, along the surface of the first developing sleeve 41A in sequence to the conveying pole S1, the layer forming pole N1, the conveying pole S2 and the handing over pole N2 (handing over portion 46). The developer G is made into a layer of even height by the layer forming member 53 when passing through the layer forming poles N1, S2.

Then, a portion of the developer G conveyed to the handing over portion 46 is handed over from the first developing roll 41 to the second developing roll 42 by moving from the handing over pole N2 to the receiving pole S4. When this occurs, the split ratio of the developer G to the first developing roll 41 or to the second developing roll 42 is determined by the maximum value of the magnetic flux density of the handing over pole N2 and the maximum value of the magnetic flux density of the receiving pole S4.

The developer G handed over to the second developing roll 42 at the handing over portion 46 is conveyed, accompanying rotation of the second developing sleeve 42A in the rotation direction d, along the surface of the second developing sleeve 42A in sequence to the developing pole N5, conveying pole S5, conveying pole N6, and pick-off pole S6. The developer G that has remained on the first developing roll 41 in the handing over portion 46, is conveyed, accompanying rotation of the first developing sleeve 41A in the rotation direction c, along the surface of the second developing sleeve 42A in sequence to the developing pole S3 and the pick-off pole N3.

At the positions GP1, GP2 facing the photoreceptor 13, the developer G moves onto the photoreceptor 13 and the latent image on the outer peripheral surface of the photoreceptor 13 is actualized (developed) with toner. The developer G remaining on the surface of the first developing sleeve 41A after developing is dropped off from the surface of the first developing sleeve 41A at the pick-off pole N3, and recovered inside the casing 37. The developer G remaining on the surface of the second developing sleeve 42A after developing is dropped off from the surface of the second developing sleeve 42A at the pick-off pole S6, rolls over the guide plate 54, and is collected in the casing 37.

Next, explanation follows regarding operation of the present exemplary embodiment.

First, a manufacturing method of the developing device 12 is explained.

As shown in FIG. 3, in the casing 37, the augers 39A, 39B are rotatably set with bearings (not shown in the figures), and the guide plate 54, to which the layer forming member 53 is fixed, is attached. Then, as shown in FIG. 4B, in the manufacturing processes of the developing device 12, when setting the first developing roll 41 in the casing 37, first the first inner body 41B is inserted into the first developing sleeve 41A, then the support shafts 41C at both ends are inserted into the cap member 43, and the first developing roll 41 is assembled by fitting the cap members 43 into the first developing sleeve 41A. Then, after inserting the shaft portion 43B of the first developing roll 41 into the through hole 37C of the side wall 37A, the shaft portion 43B is inserted into the bearing 45 and the bearing 45 is fitted into the through hole 37C. The first developing roll 41 is thereby rotatably supported by the casing 37.

Then, the non-circular shaped shaft 41D formed on one of the support shafts 41C is fitted into the through hole 70A of the angle adjustment plate 70, and the E-ring 47 is attached to an end portion of the support shaft 41C, preventing detachment of the angle adjustment plate 70. The angle adjustment plate 70 is then placed such that the fastening hole 37B of the side wall 37A is disposed in the elongated hole 70B when viewed from the main face of the angle adjustment plate 70, and the screw 49 is inserted into the elongated hole 70B and preliminary fastened in the fastening hole 37B. The angle adjustment plate 70 is movable in the arrow R direction (see FIG. 4A) in this preliminary fastened state.

The second developing roll 42 is then installed, rotatably with bearings (not shown in the figures), and the developing device 12 assembled. The developer G is then poured into the casing 37 through a filling hole (not shown in the figures) formed in a portion of the casing 37, and the augers 39A, 39B, the first developing sleeve 41A, and the second developing sleeve 42A rotated such that developer is held on the outer peripheral surface of the first developing sleeve 41A and the second developing sleeve 42A. The developing device 12 is assembled in the manner described above.

Next, explanation follows of a method of adjusting the developer holding amount of the first developing sleeve 41A and the second developing sleeve 42A using the angle adjustment plate 70.

Figure 9A:
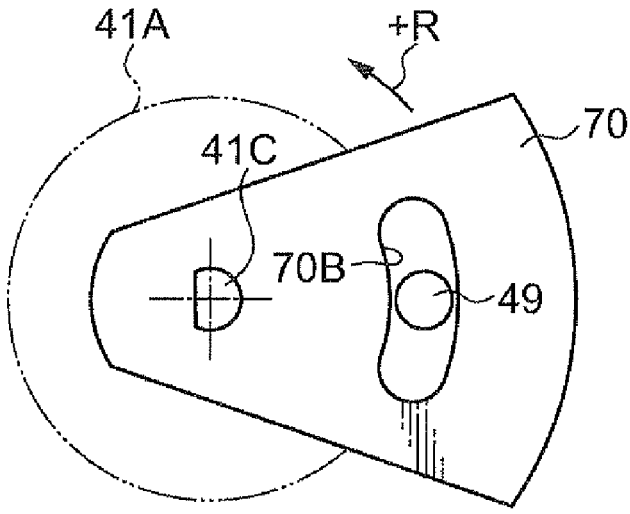
FIG. 9A and FIG. 9B are schematic diagrams showing angle adjustment states using the angle adjustment plate of a first inner body according to an exemplary embodiment of the present invention.

First, as shown in FIG. 9A, a reference position of the angle adjustment plate 70 is the position in which the screw 49 is at the arrow R direction center in the elongated hole 70B of the angle adjustment plate 70 (as an example, the position where the conveying pole S2 and the receiving pole S4 face each other). At this reference position, developer G on the outer peripheral surface of the first developing sleeve 41A in a predetermined unit of surface area is suctioned, the mass measured, and the developer holding amount per unit surface area obtained. The developer holding amount per unit surface area on the outer peripheral surface of the second developing sleeve 42A (see FIG. 3) is obtained in a similar manner.

Figure 9B:
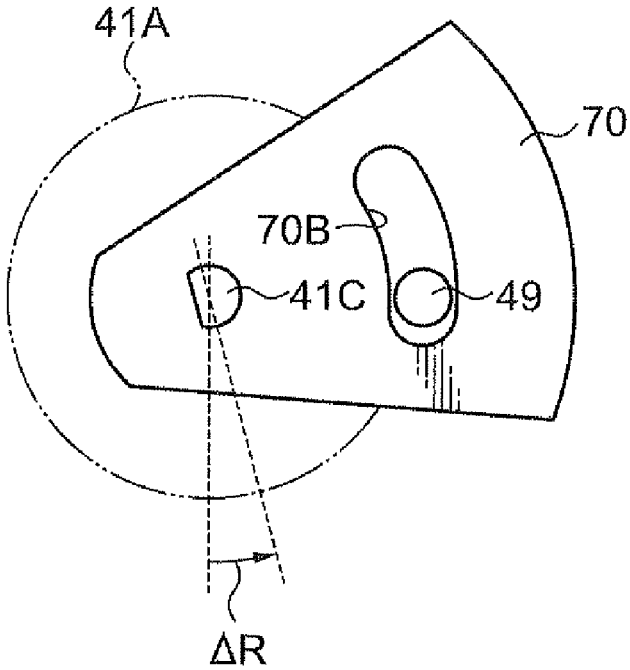

Here, as an example, the developer holding amount per unit surface area on the first developing sleeve 41A was greater than a preset first target value, and the developer holding amount per unit surface area on the second developing sleeve 42A was less than a preset second target value. In such a case, as shown in FIGS. 9A and 9B, the angle adjustment plate 70 is moved in the +R arrow direction by a rotation angle ΔR in order to reduce the developer holding amount on the first developing sleeve 41A. Note that, while in the present exemplary embodiment the angle adjustment plate 70 is moved in the +R arrow direction, movement may, however, be made in the −R arrow direction.

Figure 10:
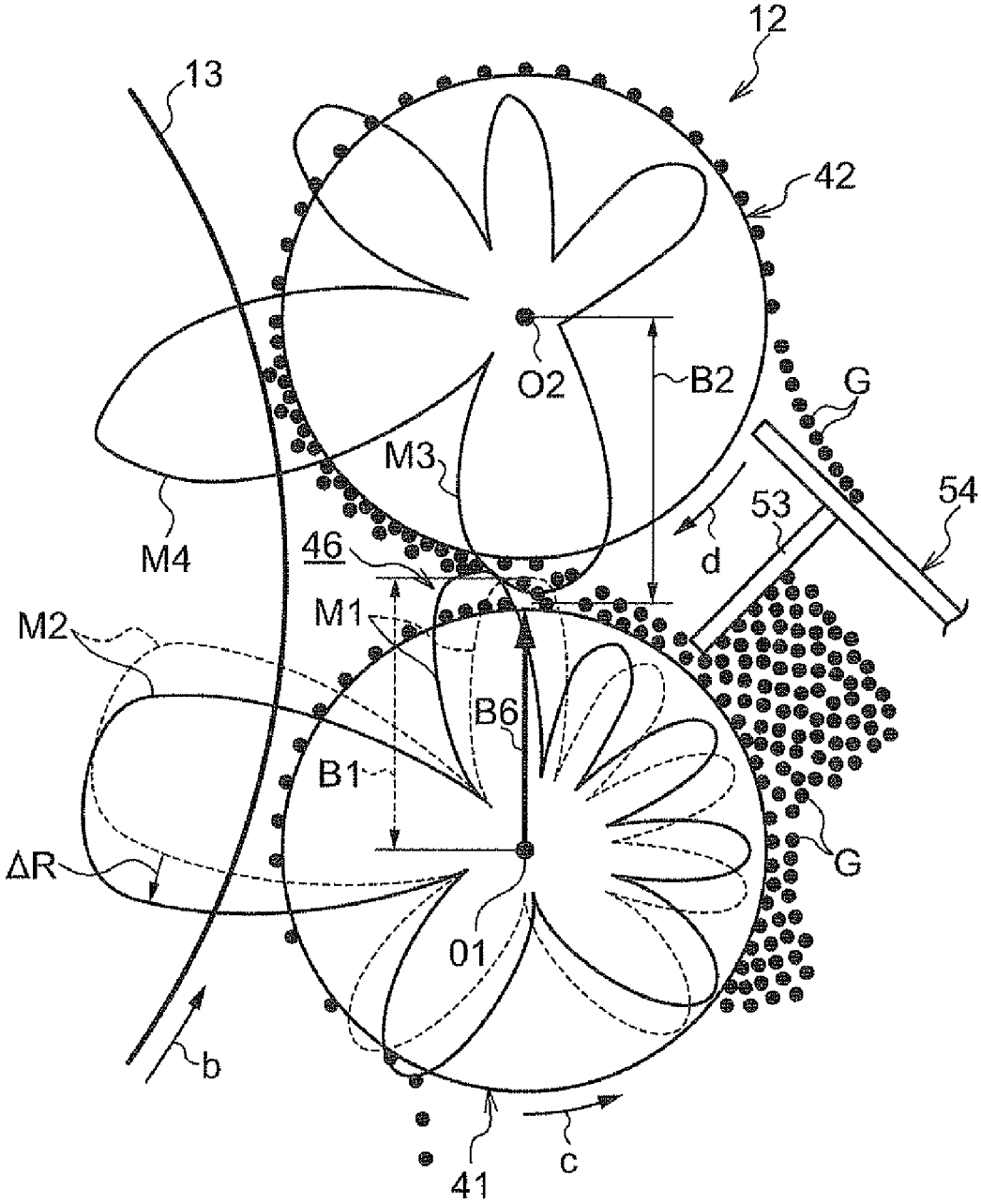
FIG. 10 is a schematic diagram showing the difference in developer holding amounts distributed to the first and second developing rolls when the angle of the first magnet is changed, at the position where the first developing roll faces the second developing roll in an exemplary embodiment of the present invention.

When the angle adjustment plate 70 is moved by the rotation angle ΔR in the +R arrow direction, as shown in FIG. 10, the whole of the magnetic flux density distribution M1 (first developing roll 41) moves by rotation angle ΔR, and the maximum value of the magnetic flux density of the handing over pole N2 (see FIG. 5) in the handing over portion 46 falls from B1 to B6. Accordingly, in the handing over portion 46, the maximum value B2 of the magnetic flux density of the magnetic flux density distribution M3 (second developing roll 42) becomes greater than the maximum value B6 of the magnetic flux density of the magnetic flux density distribution M1. In the split ratio of the developer G attracted and adhered to the first developing roll 41 or the second developing roll 42 there is an increase on the second developing roll 42 side and a decrease on the first developing roll 41 side.

Supposing that when the angle adjustment plate 70 is in the reference position, the developer G is evenly split between the first developing roll 41 and the second developing roll 42, then after moving the angle adjustment plate 70, more of the developer G is held on the second developing roll 42 side and less on the first developing roll 41 side, as shown in FIG. 10. Consequently, adjustment is performed, by measuring the developer holding amount per unit surface area on the outer peripheral surface of the first developing roll 41 and the second developing roll 42 using suction, until the developer holding amounts achieve their respective target values (as an example, amounts enabling developer G to be adhered to a latent image held on the outer peripheral surface of the photoreceptor 13). Then, after adjustment, as shown in FIG. 4B, the angle adjustment plate 70 is fastened to the casing 37 using the screw 49. The developer holding amounts of the first developing sleeve 41A and the second developing sleeve 42A are regulated in the above manner.

Note that in FIG. 10, as described above, since the magnetic flux density distribution M1 of the first developing roll 41 is a more pointed shape (has a narrower width) than the magnetic flux density distribution M3 of the second developing roll 42, the maximum value of the magnetic flux density of the magnetic flux density distribution M1 changes by a large amount even with a slight rotation angle ΔR of the magnetic flux density distribution M1. Namely, due to the sensitivity of the magnetic flux density of the magnetic flux density distribution M1 being high to changes of rotation angle ΔR of the angle adjustment plate 70 (see FIG. 4A), splitting of the developer G at the handing over portion 46 can be performed even without moving the angle adjustment plate 70 by a large rotation angle.

Figure 11A:
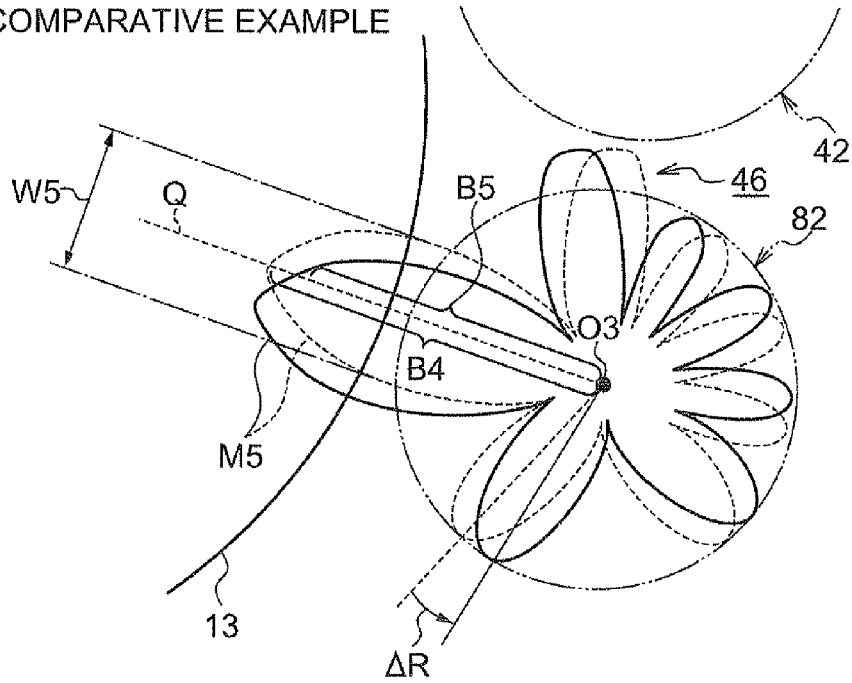
FIG. 11A is an explanatory diagram showing a magnetic flux density distribution state when the angle of a magnet is changed in a developing roll of a comparative example.

In FIG. 11A, the magnetic flux density distribution of a developing roll 82 is shown in a comparative example to that of the present exemplary embodiment. In the developing roll 82, the half value width W5 of the magnetic flux density distribution M5 at a position facing the photoreceptor 13 is smaller than the half value width W2 of the magnetic flux density distribution M1 in the present exemplary embodiment (see FIG. 5). Furthermore, in the developing roll 82, the maximum value of the magnetic flux density of the magnetic flux density distribution M5, on a radial segment Q facing from the rotational center O3 towards the photoreceptor 13, is B4. In FIG. 11A, the intermittent lines indicate the magnetic flux density distribution prior to rotation, and the solid lines indicate the magnetic flux density distribution after rotation.

Here, when the comparative example developing roll 82 is employed, when the magnetic flux density distribution is moved by the rotation angle ΔR in order to change the split of developer at the handing over portion 46, while the magnetic flux density distribution M5 at the position facing the photoreceptor 13 also moves, due to the half value width W5 of the magnetic flux density distribution M5 being small, sensitivity to rotation is high, and the maximum value B4 of the magnetic flux density of the magnetic flux density distribution M5 at the position facing the photoreceptor 13 falls to maximum value B5 with just the slightest rotation amount. Consequently, the amount of developer G standing up, i.e., forming chains (magnetic brush) facing the photoreceptor 13 is reduced, and the developer amount for the latent image held on the outer peripheral surface of the photoreceptor 13 is reduced. When the comparative example developing roll 82 is used in this manner, since adjusting the split of developer at the handing over portion 46 influences the developer amount on the photoreceptor 13, adjusting the split of developer at the handing over portion 46 becomes difficult.

Figure 11B:
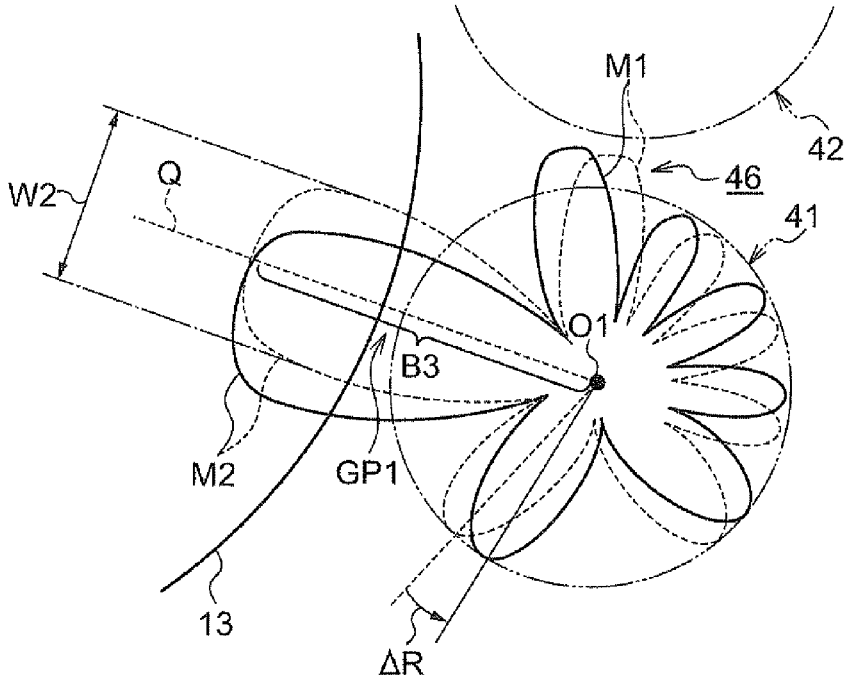
FIG. 11B is an explanatory diagram showing a magnetic flux density distribution state when the angle of a first inner body is changed in a first developing roll according to an exemplary embodiment of the present invention.

However, as shown in FIG. 11B, in cases where the first developing roll 41 of the present exemplary embodiment is employed, when the magnetic flux density distribution of the first inner body 41B (see FIG. 3) is moved by rotation angle ΔR in order to change the split of developer at the handing over portion 46, the magnetic flux density distribution M2 of the position GP1 facing the photoreceptor 13 also moves. However, due to the half value width W2 of the magnetic flux density distribution M2 being larger than the half value width W5 of the comparative example, or the half value width W4 of the magnetic flux density distribution M4 of the second developing roll 42 (see FIG. 5), the sensitivity to rotation is lowered, and the maximum value of the magnetic flux density of the magnetic flux density distribution M2 at the position GP1 facing the photoreceptor 13 does not substantially change and stays at B3. Consequently, the amount of developer G standing up (magnetic brush) facing the photoreceptor 13 does not change, and the developer amount for the latent image held on the outer peripheral surface of the photoreceptor 13 also does not change.

In cases where the first developing roll 41 of the present exemplary embodiment is employed, due to the width of the half value width W2 of the magnetic flux density distribution M2 being wider, the magnetic field at the position GP1 (developing nip portion) facing the photoreceptor 13 is weakened when the split amount of the developing agent is adjusted.

Accordingly, in the developing device 12 according to the present exemplary embodiment, since the split ratio of the developer G is regulated by adjusting the magnetic force at the handing over portion 46, this enables the magnetic force tolerance to be increased in comparison with cases where the magnetic force at the handing over portion 46 cannot be regulated.

The present invention is not limited to the above exemplary embodiment.

The rotation direction of the photoreceptor 13 may be the opposite direction (the clockwise direction in the figures). In such cases, at the position GP1 facing the photoreceptor 13, the movement direction of the first developing sleeve 41A is the same direction at the rotation direction of the photoreceptor 13, and at the position GP2 facing the photoreceptor 13, the movement direction of the second developing sleeve 42A is the opposite direction to the rotation direction of the photoreceptor 13.

Furthermore, in the present exemplary embodiment, the angle of the first inner body 41B of the first developing roll 41 disposed at the photoreceptor 13 rotation direction upstream side is changed, due to the second developing roll 42 disposed at the rotation direction downstream side of the photoreceptor 13 more readily influencing the final quality of toner images on the photoreceptor 13. However, angular change (adjustment) may also be performed to the second developing roll 42. In such cases, the magnetic flux density distribution of the second developing roll 42 may be configured in a similar manner to the magnetic flux density distribution of the first developing roll 41. Angular change may also be performed to both the first developing roll 41 and the second developing roll 42.

Measurement of the developer amount at the outer peripheral surface of the first developing sleeve 41A may not only be made by a method that measures the developer mass per unit surface area, but also, for example, by measuring the height of the developer G chain formation (magnetic brush) using laser displacement measurement. The placement of each of the magnetic poles in the first developing roll 41 and the second developing roll 42 may also be freely made outside of the handing over portion 46 and the positions GP1, GP2 facing the photoreceptor 13.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device, comprising:

a first developer holding body comprising a first cylinder member that is disposed facing the outer peripheral surface of a rotating latent image holding body and rotates such that a movement direction of the first cylinder member at a position facing the latent image holding body is the opposite direction to that of the latent image holding body, and a first magnet that is disposed at the inside of the first cylinder member and generates a magnetic field distributed along a circumferential direction at the outside of the first cylinder member, the first developer holding body holding a developer, for developing a latent image on the latent image holding body;

a second developer holding body comprising a second cylinder member that is disposed facing the outer peripheral surface of the latent image holding body, further to the downstream side in the rotation direction of the latent image holding body than the first developer holding body, and rotates such that a movement direction of the second cylinder member at a position facing the latent image holding body is the same direction as that of the latent image holding body, and a second magnet that is disposed at the inside of the second cylinder member and generates a magnetic field distributed along a circumferential direction at the outside of the second cylinder member, the second developer holding body holding the developer, for developing the latent image on the latent image holding body; and an adjustment mechanism that adjusts the relative position of the first magnet to the second magnet in a circumferential direction.

2. The developing device of claim 1, wherein the adjustment mechanism adjusts the relative position of the first magnet and the second magnet in the circumferential direction by moving the first magnet side.

3. The developing device of claim 1, wherein, at a position where the first developer holding body faces the second developer holding body, a range where the magnetic flux density of the first magnet is a predetermined proportion of the maximum magnetic flux density of the first magnet is narrower in the circumferential direction than a range where the magnetic flux density of the second magnet is a predetermined proportion of the maximum magnetic flux density of the second magnet.

4. The developing device of claim 1, wherein, at a position facing the latent image holding body of the first magnet, a range where the magnetic flux density of the first magnet is a predetermined proportion of the maximum magnetic flux density of the first magnet is wider in the circumferential direction than, at a position facing the latent image holding body of the second magnet, a range where the magnetic flux density of the second magnet is a predetermined proportion of the maximum magnetic flux density of the second magnet.

5. An image forming apparatus comprising:

a photoreceptor that is a latent image holding body;

a charging unit that charges the photoreceptor;

an exposure unit that light-exposes the surface of the photoreceptor after it has been charged;

the developing device of claim 1 that develops the latent image formed on the photoreceptor by the light exposure by the exposure unit, with a developer; and a transfer unit that transfers a developer image, developed on the surface of the photoreceptor by the developing device, onto a transfer receiving medium.

6. A developing device comprising:

a first developer holding body comprising a first cylinder member that is disposed facing the outer peripheral surface of a rotating latent image holding body and rotates such that a movement direction of the first cylinder member at a position facing the latent image holding body is the opposite direction to that of the latent image holding body, and a first magnet that is disposed at the inside of the first cylinder member and generates a magnetic field distributed along a circumferential direction at the outside of the first cylinder member, the first developer holding body holding a developer, for developing a latent image on the latent image holding body;

a second developer holding body comprising a second cylinder member that is disposed facing the outer peripheral surface of the latent image holding body, further to the downstream side in the rotation direction of the latent image holding body than the first developer holding body, and rotates such that a movement direction of the second cylinder member at a position facing the latent image holding body is the same direction as that of the latent image holding body, and a second magnet that is disposed at the inside of the second cylinder member and generates a magnetic field distributed along a circumferential direction at the outside of the second cylinder member, the second developer holding body holding the developer, for developing the latent image on the latent image holding body; and a casing that houses the first developer holding body and the second developer holding body, the first magnet and the second magnet being fixed to the casing, and the relative position of the first magnet to the second magnet in a circumferential direction thereof being adjustable by rotating at least one of the magnets relative to the casing.

7. The developing device of claim 6, wherein the second magnet is attached to the casing in a fixed manner, and the relative position of the first magnet to the casing is adjustable in a circumferential direction.

8. The developing device of claim 7, further comprising a plate member that is attached to the casing and whose position is adjustable in a rotation direction relative to the casing, wherein an axial portion of the first magnet is attached to the plate member in a fixed manner.

9. The developing device of claim 6, wherein, at a position where the first developer holding body faces the second developer holding body, a range where the magnetic flux density of the first magnet is a predetermined proportion of the maximum magnetic flux density of the first magnet is narrower in the circumferential direction than a range where the magnetic flux density of the second magnet is a predetermined proportion of the maximum magnetic flux density of the second magnet.

10. The developing device of claim 6, wherein, at a position facing the latent image holding body of the first magnet, a range where the magnetic flux density of the first magnet is a predetermined proportion of the maximum magnetic flux density of the first magnet is wider in the circumferential direction than, at a position facing the latent image holding body of the second magnet, a range where the magnetic flux density of the second magnet is a predetermined proportion of the maximum magnetic flux density of the second magnet.

* * * * *